US010320116B2

(12) United States Patent
Miyamura et al.

(10) Patent No.: US 10,320,116 B2
(45) Date of Patent: Jun. 11, 2019

(54) TERMINAL UNIT

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Hajime Matsui, Mie (JP); Takuma Hibino, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/896,122

(22) Filed: Feb. 14, 2018

(65) Prior Publication Data

US 2018/0254579 A1 Sep. 6, 2018

(51) Int. Cl.

| | |
|---|---|
| ***H01R 13/533*** | (2006.01) |
| ***H01R 13/6592*** | (2011.01) |
| ***H01R 13/436*** | (2006.01) |
| *H01R 9/03* | (2006.01) |
| *H01R 103/00* | (2006.01) |
| *H01R 4/18* | (2006.01) |
| *H01R 13/6463* | (2011.01) |

(52) U.S. Cl.

CPC ..... *H01R 13/533* (2013.01); *H01R 13/4365* (2013.01); *H01R 13/6592* (2013.01); *H01R 4/183* (2013.01); *H01R 4/187* (2013.01); *H01R 9/035* (2013.01); *H01R 13/6463* (2013.01); *H01R 2103/00* (2013.01); *H01R 2201/26* (2013.01)

(58) Field of Classification Search

CPC ..... H01R 13/533; H01R 23/02
USPC ..... 439/660
See application file for complete search history.

(56) References Cited

U.S. PATENT DOCUMENTS

| | | | | |
|---|---|---|---|---|
| 9,318,826 | B2 * | 4/2016 | Kato | B60L 11/14 |
| 2005/0048843 | A1 * | 3/2005 | Iida | H01R 13/7197 439/620.07 |
| 2015/0280342 | A1 * | 10/2015 | Kato | H01R 31/08 439/34 |

FOREIGN PATENT DOCUMENTS

| | | |
|---|---|---|
| JP | 2004-055470 | 2/2004 |

* cited by examiner

*Primary Examiner* — Tulsidas C Patel
*Assistant Examiner* — Peter G Leigh
(74) *Attorney, Agent, or Firm* — Gerald E. Hespos; Michael J. Porco; Matthew T. Hespos

(57) ABSTRACT

A terminal unit includes inner conductors (35) fixed to front ends of wires (38). A dielectric (10) has a holding member (11) and a cover (27) united in a direction intersecting an axial direction of the wires (38) and accommodates the inner conductors (35). Guide recesses (17) are formed on the holding member (11) and extend in a front-rear direction. Guide ribs (33) are formed on the cover (27) and can slide in contact with the guide recesses (17) to allow relative displacement of the holding member (11) and the cover (27) in the front-rear direction while keeping the holding member (11) and the cover (27) united. Guides (19) bring the holding member (11) and the cover (27) closer together in a uniting direction while displacing the cover (27) from a temporary assembled position to a proper assembled position in the front-rear direction.

10 Claims, 11 Drawing Sheets

TERMINAL UNIT

BACKGROUND

Field of the Invention

The invention relates to a terminal unit.

Related Art

Japanese Unexamined Patent Publication No. 2004-055470 discloses a connector used in an in-vehicle LAN (Local Area Network). A wiring harness for the in-vehicle LAN has power supply wires for supplying power to devices, such as a car navigation system, and communication wires constituting a twisted pair cable to provide a measure against noise.

Terminal fittings are fixed to front end parts of two communication wires of the twisted pair cable and are inserted individually into terminal accommodating chambers in a housing. The terminal fittings are inserted from behind and in a direction substantially parallel to a length direction of the communication wires. Thus, the front end parts of the two communication wires must be untwisted to ensure an extra length for the individual insertion. However, an anti-noise function is lost by untwisted regions of the communication wires.

The communication wires could remain twisted by providing a terminal accommodating member that has a halved structure and that is formed separate from the housing. The terminal fittings that are connected to the communication wires are mounted into the halved members in a direction intersecting the length direction of the communication wires. Thus, the communication wires need not be untwisted and the anti-noise function is not reduced.

However, the halved members may rattle in a uniting direction due to dimensional tolerances. A large amount of rattling of the halved members may permit the terminal fittings to rattle. Therefore a countermeasure is desired.

The invention was completed based on the above situation and aims to suppress rattling in a united state of a terminal accommodating member.

SUMMARY

One aspect of the invention relates to a terminal unit that has at least one terminal fitting fixed to at least one wire. The terminal unit includes a terminal accommodating member that is configured by uniting first and second members in a direction intersecting an axial direction of the wire. The terminal accommodating member is configured to at least partly accommodate the terminal fitting. At least one first guide is formed on the first member and extends in a substantially front-rear direction. At least one second guide is formed on the second member and can slide in contact with the first guide. The first and second guides are configured to allow the first and second members to be displaced in the front-rear direction while keeping the first and second members in a united state. At least one guiding portion is formed in the first guide and is configured to bring the first and second members closer to each other in a uniting direction in the process of displacing the second member from a temporary assembled position to a proper assembled position in the front-rear direction.

The first and second guides may lock together to prevent separation of the first and second members in a direction opposite to the uniting direction. According to this configuration, the shapes of the first and second members are simplified as compared to the case where guides are separate from the structures for holding the first and second members together.

The first guide may have at least one rattling allowing portion, the guiding portion and at least one rattling preventing portion disposed substantially side by side one after another on an outer side surface of the first member.

At least one resiliently deformable side plate may be cantilevered from the second guide substantially in the uniting direction with the first member.

The second guide may be a projection formed on an extending end part of the side plate.

The second guide may face the rattling allowing portion with a clearance defined therebetween when the second member is at the temporary assembled position and may be in contact with the rattling preventing portion when the second member is at the proper assembled position.

According to this configuration, if the second member is united toward the proper assembled position, the resiliently deformed side plate becomes oblique to the uniting direction. Thus, the second guide cannot be locked to the rattling preventing portion and is left resiliently deformed. In contrast, if the second member is united toward the temporary assembled position, the side plate resiliently returns and the second guide faces the rattling allowing portion even if the resiliently deformed side plate becomes oblique since the clearance is secured between the rattling allowing portion and the second guide.

A tubular terminal body may be formed at a front end part of the terminal fitting and may be connectable to a mating terminal, and the guiding portion may be disposed at a position substantially corresponding to the terminal body in the front-rear direction. According to this configuration, rattling of the terminal body, serving as a connection means to the mating terminal, can be suppressed. Thus, the terminal fitting and the mating terminal can be prevented from interfering with each other without being smoothly connected.

The guiding portion may be at a front end part of the first member. At least one lock projection may formed on an outer side surface of a rear end part of the first member. The second member may be formed with at least one resilient deformable locking portion cantilevered in the uniting direction with the first member. At least one locking projection may be formed on an extending end part of the resilient locking portion and may be configured to hold the first and second members in the united state by being locked to the lock projection in a state where the second member is at the proper assembled position.

A correcting slope may be formed in a region of an outer side surface of the lock projection on the side of the temporary assembled position. The correcting slope may be configured to reduce the amount of resilient deformation of the resilient locking portion more as the second member approaches the first member when the locking projection interferes with the correcting slope in the process of displacing the second member toward the proper assembled position.

The second member may be displaced in an oblique posture toward the proper assembled position with respect to the first member. In this situation, the locking projection interferes with the correcting slope, and the posture of the second member is corrected by a resilient restoring force of the resilient locking portion. The correcting slope is formed on the outer side surface of the lock projection. Thus, a locking margin between the locking projection and the lock projection can be ensured.

The first member may be formed with at least one stopper substantially extending along the uniting direction of the second member, and the second member may be formed with at least one abutting portion extending substantially along the uniting direction with the first member and configured to contact the stopper in a state where the second member is at the proper assembled position. According to this configuration, the second member cannot incline with respect to the first member.

If the second member is displaced to the proper assembled position by the first and second guides in a state where the second member is united with the first member at the temporary assembled position, both members are brought closer to each other in the uniting direction by the guiding portion. In this way, the rattling of the first and second members in the uniting direction is suppressed.

These and other features and advantages of the invention will become more apparent upon reading the following detailed description and accompanying drawings. It should be understood that even though embodiments are described separately, single features may be combined to additional embodiments.

DETAILED DESCRIPTION

Figure 1:
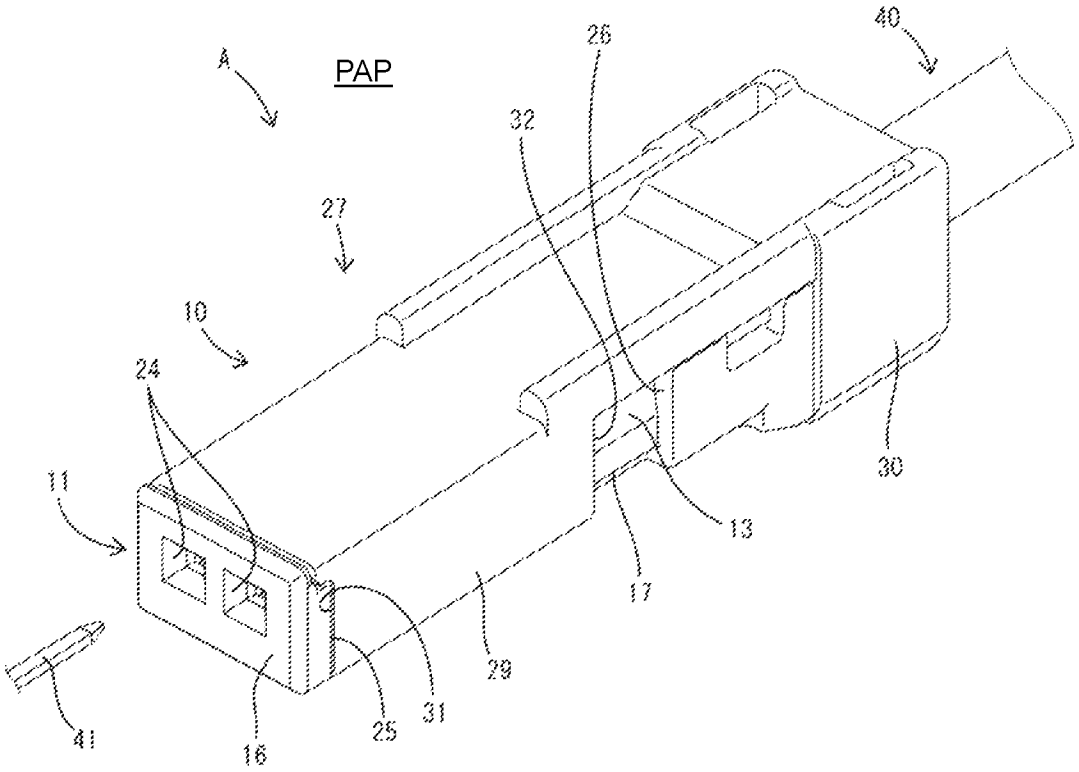
FIG. 1 is a perspective view showing a state where a cover member is mounted at a proper assembled position in a terminal unit of one embodiment.
Figure 2:
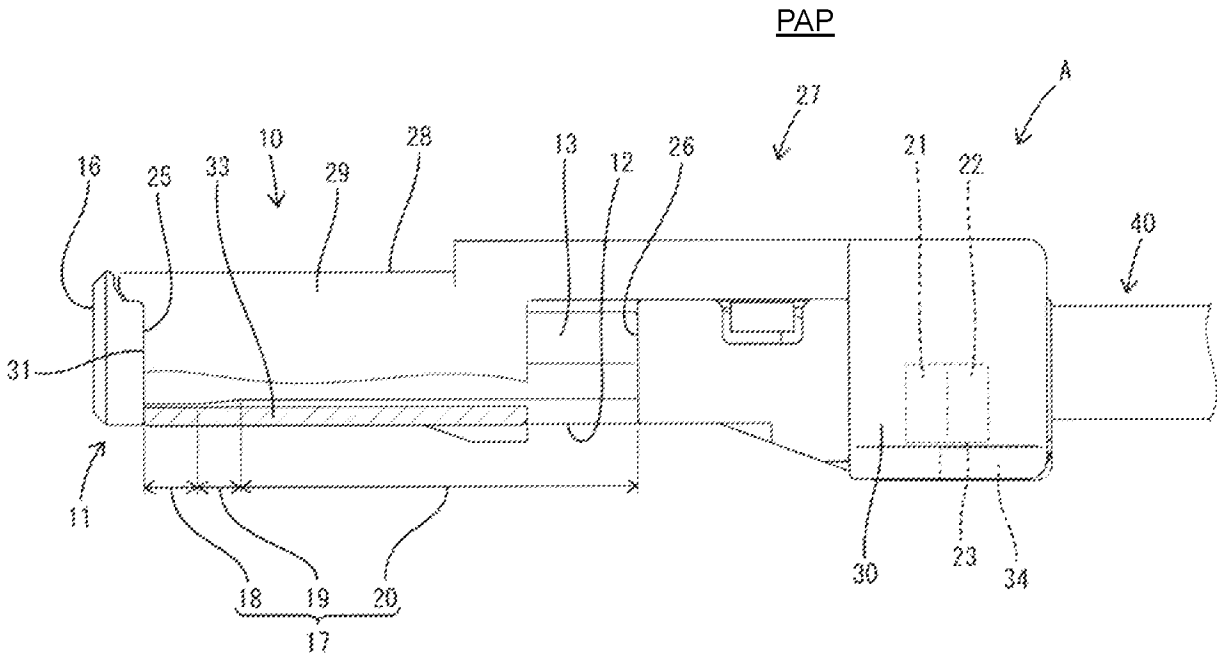
FIG. 2 is a side view showing the state where the cover member is mounted at the proper assembled position.
Figure 3:
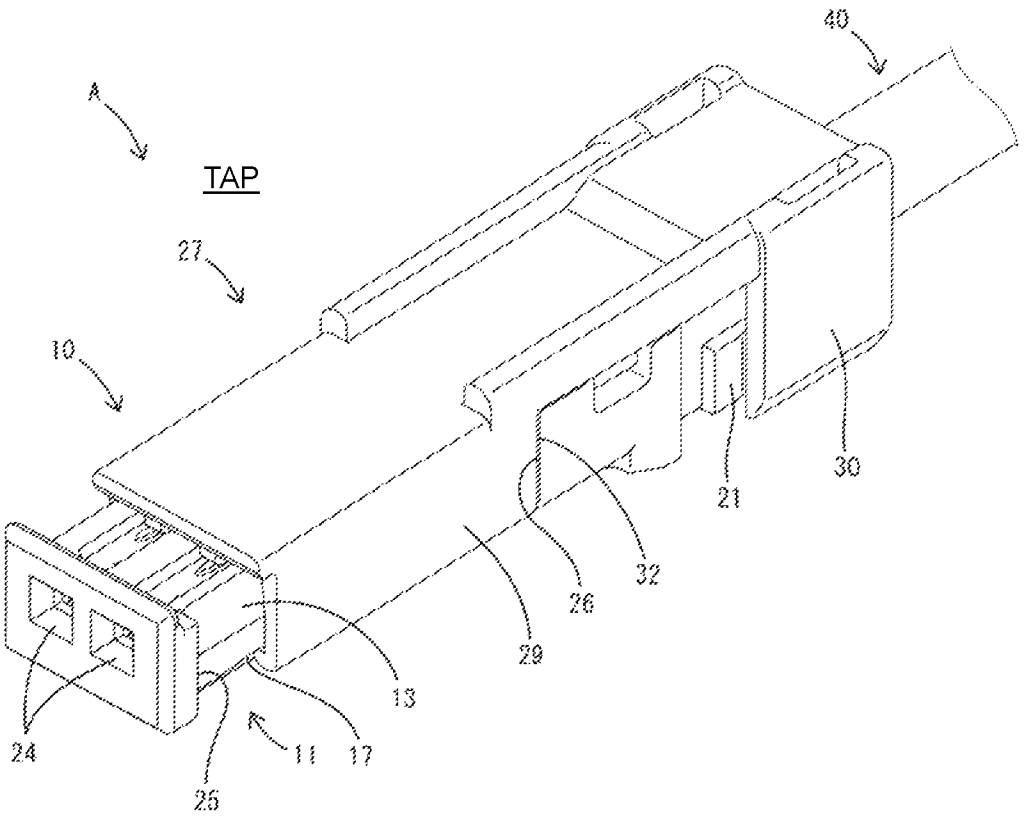
FIG. 3 is a perspective view showing a state where the cover member is mounted at a temporary assembled position.
Figure 4:
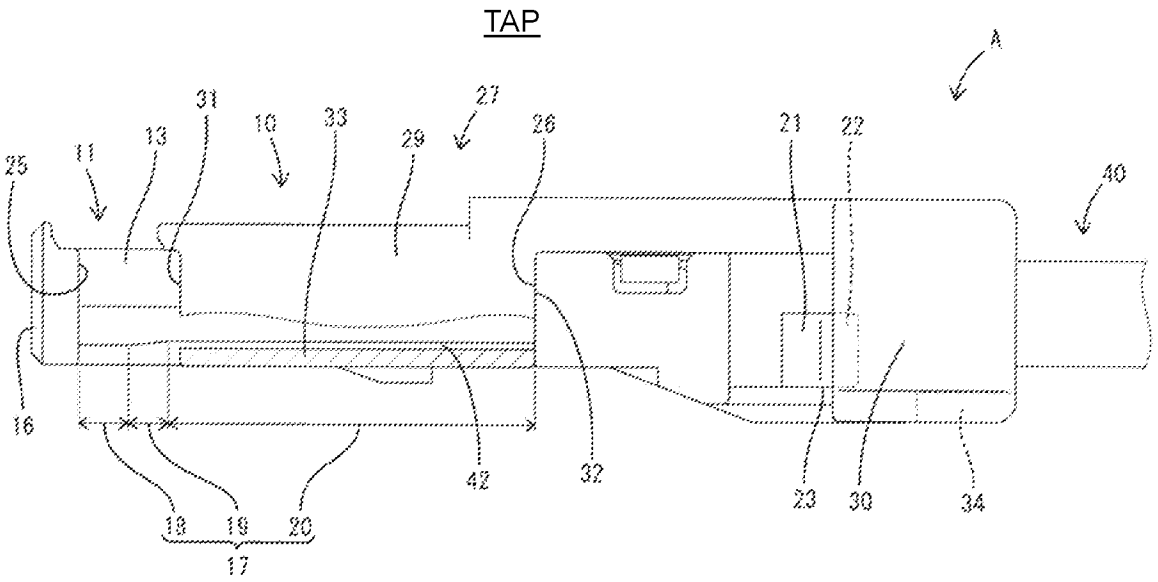
FIG. 4 is a side view showing the state where the cover member is mounted at the temporary assembled position.
Figure 5:
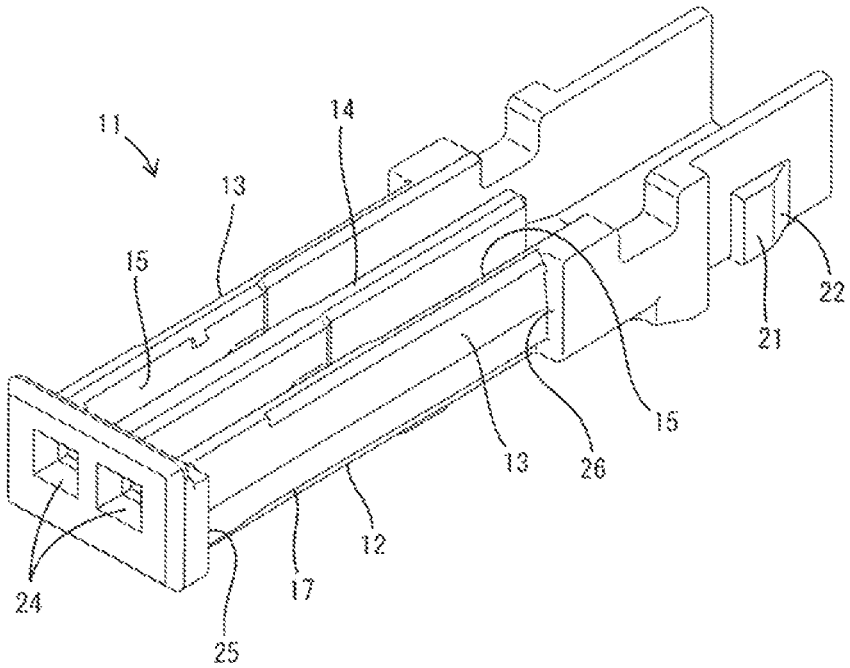
FIG. 5 is a perspective view of a holding member.
Figure 6:
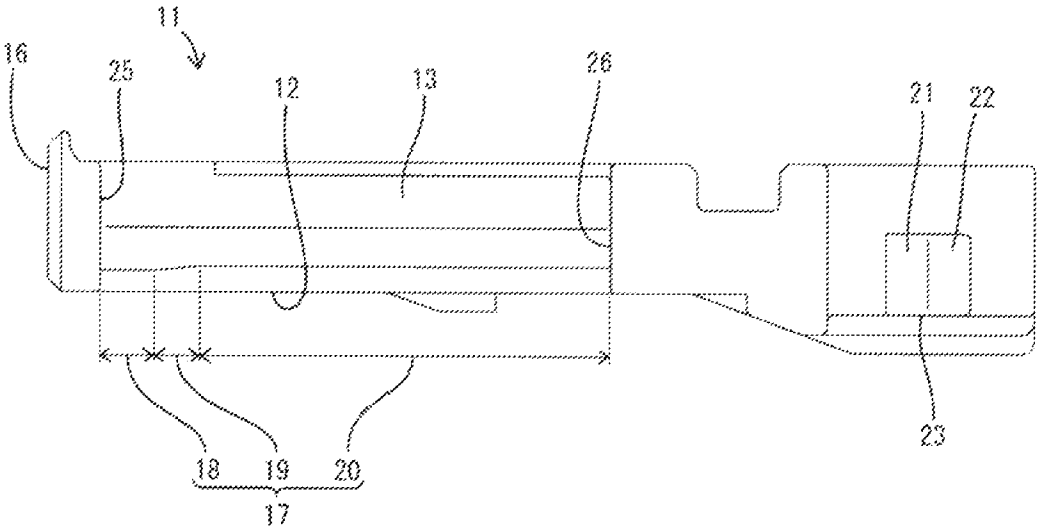
FIG. 6 is a side view of the holding member.
Figure 7:
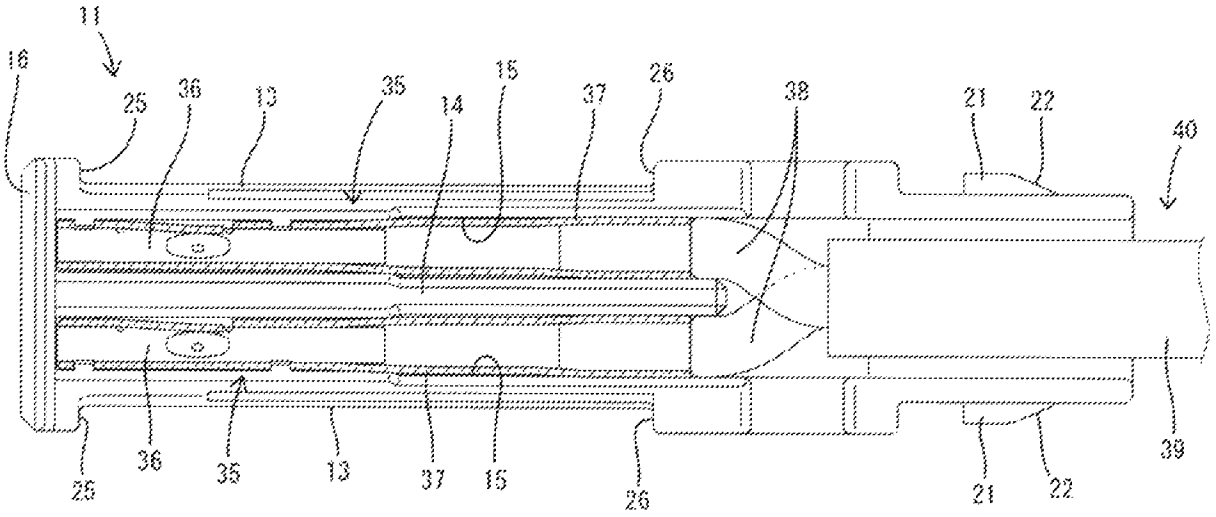
FIG. 7 is a plan view of a state where inner conductors are accommodated in the holding member.
Figure 8:
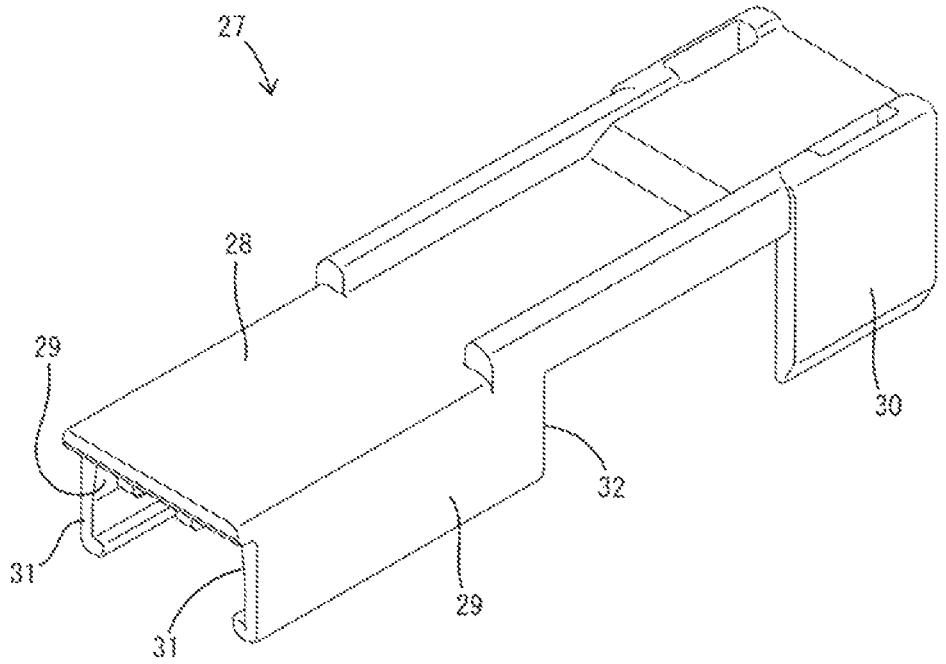
FIG. 8 is a perspective view of the cover member.
Figure 9:
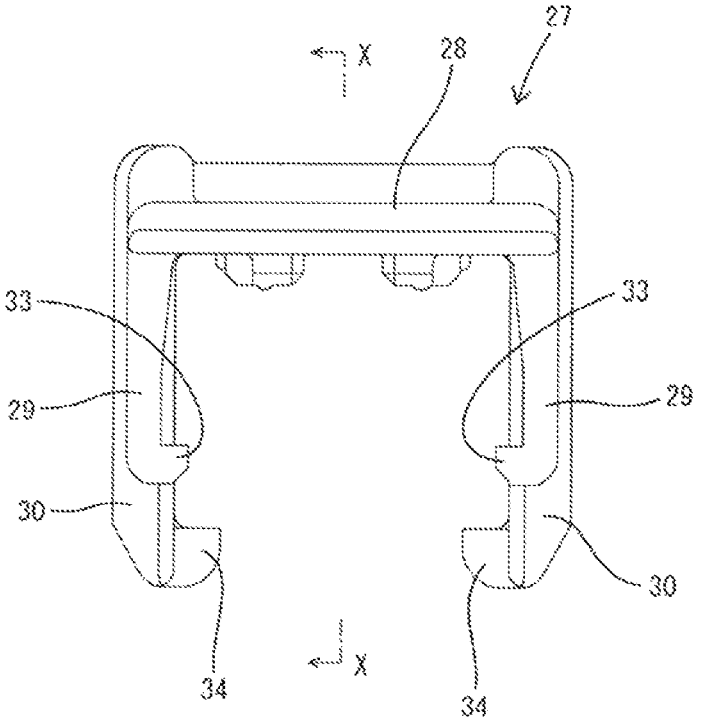
FIG. 9 is a front view of the cover member.
Figure 10:
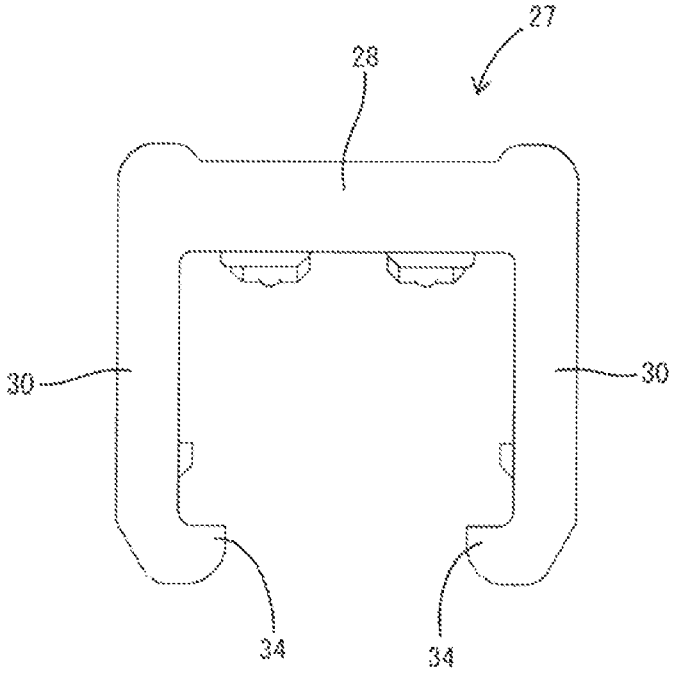
FIG. 10 is a back view of the cover member.
Figure 11:
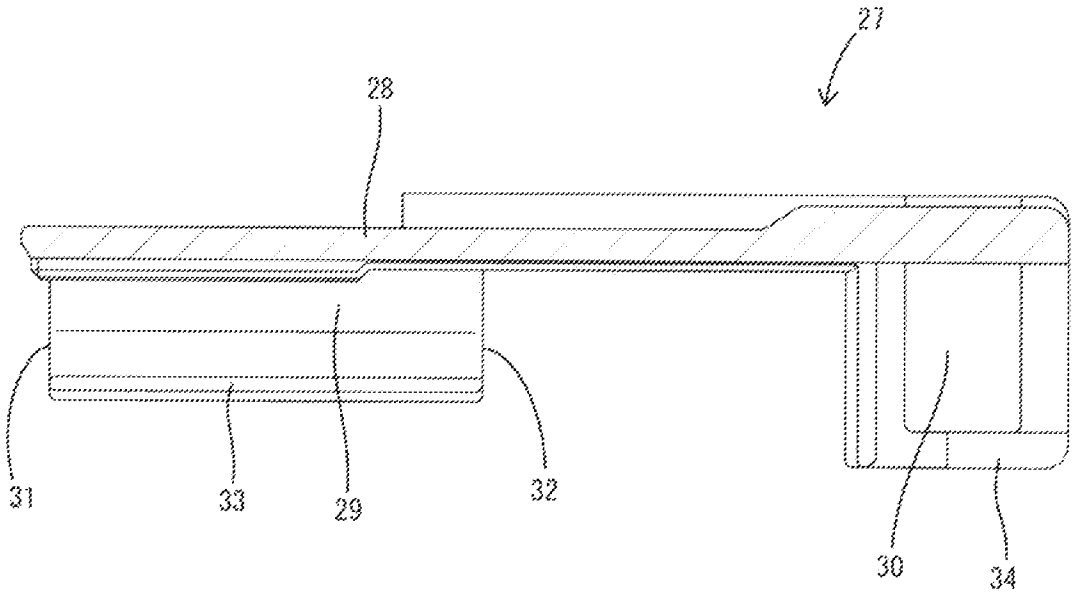
FIG. 11 is a section along X-X of FIG. 9.

One specific embodiment of the invention is described with reference to FIGS. 1 to 11. In the following description, a left side in FIGS. 1 to 8 and 11 is defined as a front side concerning a front-rear direction. Upper and lower sides shown in FIGS. 1 to 6 and 8 to 11 are defined as upper and lower sides concerning a vertical direction.

A terminal unit A of this embodiment includes a dielectric 10 (terminal accommodating member as claimed) made of synthetic resin and two inner conductors 35 (terminal fitting as claimed), and constitutes a shield terminal (not shown) having a shielding function. The dielectric 10 is configured by assembling a halved holding member 1 (first halved member as claimed) and a halved cover member 27 (second halved member as claimed).

The holding member 11 is long and narrow in the front-rear direction and includes a bottom wall 12, two side walls 13 projecting up from left and right sides of the bottom wall 12, and a front wall 16 connected to the front ends of the bottom wall 12 and the side walls 13. A partition wall 14 projects up in a lateral intermediate position of the bottom wall 12, and left and right accommodating chambers 15 are defined in the holding member 11 by the partition wall 14 and the side walls 13. The accommodating chambers 15 are open in the upper and rear surfaces of the holding member 11. The inner conductors 35 are accommodated respectively in the accommodating chambers 15, and a retaining projection for restricting a rearward displacement of the inner conductor 35 is formed on the bottom surface of each accommodating chamber 15.

Two bilaterally symmetrical guide recesses 17 (first guides as claimed) are formed in front end side regions of outer side surfaces of the left and right side walls 13. Each guide recess 17 is formed by recessing a lower end of the outer side surface of the side wall 13 with a step formed between the lower and upper ends, and is long and narrow in the front-rear direction. A rattling preventing portion 18 is disposed at a front end part of each guide recess 17. A guiding portion 19 extends rearward from the rear end of the rattling preventing portion 18 and a rattling allowing portion 20 extends from the rear end of the guiding portion 19 to the rear end of the guide recess 17. The rattling preventing portion 18, the guiding portion 19 and the rattling allowing portion 20 faces down (same direction as a uniting direction of the holding member 11 with the cover 27).

The rattling preventing portion 18 and the rattling allowing portion 20 extend straight in the front-rear direction (perpendicular to the uniting direction of the holding member 11 and the cover 27). A length of the rattling preventing portion 18 in the front-rear direction is shorter than that of the rattling allowing portion 20 in the front-rear direction. The rattling preventing portion 18 is lower (before in the uniting direction of the cover 27 with the holding member 11) than the rattling allowing portion 20. In a side view, the guiding portion 19 is inclined to be lower toward the front due to a height difference between the rattling preventing portion 18 and the rattling allowing portion 20.

Two lock projections 21 are formed on rear end parts of the outer side surfaces of the left and right side walls 13. A rear end region of an outer side surface of the lock projection 21 serves as a correcting slope 22. The correcting slope 22 is inclined to project more from the side wall 13 toward the front in a plan view. The lower surface of the lock projection 21 serves as a locking surface 23 in the front-rear direction (direction perpendicular to the uniting direction of the cover 27 with the holding member 11).

Left and right through holes 24 penetrate the front wall 16 from the front end surface of the holding member 11 to the respective accommodating chambers 15. Mating terminals 41 in the form of long, narrow tabs are inserted into the through holes 24. Rearwardly facing front stops 25 are formed on left and right side edges of the front wall 16 and extend vertically parallel to the uniting direction of the cover 27 with the holding member 11. Rearward movement restricting portions 26 face forward at the rear ends of the guide recesses 17 on the left and right side walls 13 and extend vertically.

The cover 27 is long and narrow in the front-rear direction and includes an upper plate 28, bilaterally symmetrical side plates 29 and bilaterally symmetrical resilient locking portions 30. The side plates 29 extend down substantially at a right angle from front end side regions of both left and right side edges of the upper plate 28. The front edges of the left and right side plates 29 serve as front abutting portions 31 and extend vertically. The rear edges of the left and right side plates 29 serve as rear abutting portions 32 and extend vertically.

The side plates 29 can be deformed resiliently to be wider apart in a lateral direction with the upper ends (boundary parts with the upper plate 28) as supports. Guide ribs 33 (second guide portion as claimed) project over the entire areas of the lower end edges of the inner surfaces of the side plates 29 in the front-rear direction. A vertical dimension from the lower surface of the upper plate 28 to the upper surface of the guide rib 33 is equal to or slightly larger than a vertical distance from the upper end surface of the side wall 13 of the holding member 11 to the rattling preventing portion 18.

The resilient locking portions 30 are in the form of plates extending down substantially at a right angle from rear end parts of both left and right side edges of the upper plate 28. The resilient locking portions 30 can be deformed resiliently to be wider apart in the lateral direction with the upper ends (boundary parts with the upper plate 28) thereof as supports. Locking projections 34 project in from rear ends of the lower end edges of the inner surfaces of the resilient locking portions 30. A vertical dimension from the lower surface of the upper plate 28 to the upper surface of the locking projection 34 is equal to or slightly larger than a vertical distance from the upper end surface of the side wall 13 of the holding member 11 to the locking surface 23 of the lock projection 21.

The inner conductor 35 is long and narrow in the front-rear direction. A front end of the inner conductor 35 defines a conductor body 36 (terminal body as claimed) into which the mating terminal 41 is inserted and conductively connected. A retaining portion (not shown) is formed on the lower surface of the conductor body 36 and is lockable to the retaining projection (not shown) of the holding member 11. The retaining portion is locked to the retaining projection to restrict rearward separation of the inner conductor 35 accommodated in the accommodating chamber 15 from the holding member 11.

A rear region of the inner conductor 35 defines a crimping portion 37 in the form of an open barrel extending rearward from the rear end of the conductor body 36. A front end part of a wire 38 is fixed conductively to the crimping portion 37. Two wires 38 fixed to the two inner conductors 35 constitute a twisted pair cable 40. The twisted pair cable 40 exhibits a shielding function of suppressing electromagnetic noise by spirally twisting the two wires 38. Although the two wires 38 are covered with an outer cover 39, the outer cover 39 is removed at a front end part of the twisted pair cable 40 and the two wires 38 are exposed in an untwisted state.

The two inner conductors 35 individually fixed to the front end parts of the wires 38 are accommodated into the accommodating chambers 15 from above the holding member 11. In the case of individually inserting the inner conductors 35 one by one from behind the holding member 11, it is necessary to ensure an extra length (exposed length) of the wire 38 from the outer cover 39 to the inner conductor 35 and untwist the wire 38 in that extra length region, but the shielding function cannot be exhibited in the untwisted region. In that respect, since the inner conductor 35 is dropped into or arranged in the accommodating chamber 15 to be accommodated in a direction perpendicular to a length direction of the wire 38 from above the holding member 11 in the terminal unit A of this embodiment, a length of an untwisted region of the wire 38 can be suppressed to a minimum necessary length.

Next, how to assemble the terminal unit A is described. First, the two inner conductors 35 fixed to the wires 38 are accommodated into the accommodating chambers 15 of the holding member 11. Subsequently, the cover 27 is mounted and united with the holding member 11 from above. The uniting direction of the holding member 11 and the cover member 27 is the vertical direction (direction perpendicular to the length direction of the wires 38). In the united or assembled state, the side plates 29 cover the front end side regions of the outer side surfaces of the side walls 13 where the guide recesses 17 are formed and the resilient locking portions 30 cover the rear end regions of the outer side surfaces of the side walls 13 where the lock projections 21 are formed.

In uniting, the cover 27 is assembled at a temporary assembled position TAP (see FIGS. 3 and 4) as a first position. The temporary assembled position TAP is a position where the rear abutting portions 32 of the cover 27 are in contact with the rearward movement restricting portions 26 of the holding member 11 or proximately facing the rearward movement restricting portions 26 in the front-rear direction. In a state where the cover 27 is at the temporary assembled position TAP, the front abutting portions 31 are located behind the front stops 25. Further, the front ends of the locking projections 34 are located behind the rear ends of the lock projections 21.

Further, in the state where the cover 27 is at the temporary assembled position TAP, the front ends of the guide ribs 33 are behind the rear ends of the guiding portions 19. That is, the upper surfaces of the guide ribs 33 face the rattling allowing portions 20 over the entire lengths thereof with clearances 42 (see FIG. 4) defined therebetween in the vertical direction. The guide ribs 33 interfere with regions of the outer side surfaces of the side walls 13 above the guide recesses 17 in the process of uniting the cover 27 with the holding member 11. Thus, the side plates 29 are deformed resiliently to be wider apart in the lateral direction. When the side plates 29 are deformed resiliently, the positions of the guide ribs 33 become slightly higher. However, since the clearances 42 are secured between the guide ribs 33 and the rattling allowing portions 20 in a state where the side plates 29 are not deformed resiliently, the side plates 29 resiliently return and the guide ribs 33 can slip under the rattling allowing portions 20 when the upper plate 28 contacts the upper ends of the side walls 13 and the cover 27 and the holding member 11 are united completely.

After the cover member 27 is assembled at the temporary assembled position TAP, the cover 27 is slid forward with respect to the holding member 11. In the process of moving the cover 27, front end parts of the guide ribs 33 slip under the guiding portions 19. At this time, if the cover 27 is lifted (displaced in a direction intersecting a moving direction of the cover 27) with respect to the holding member 11, the front ends of the guide ribs 33 slide in contact with the guiding portions 19. Thus, a front end part of the cover 27 is displaced down with respect to the holding member 11. When the cover 27 reaches a proper assembled position PAP (see FIGS. 1 and 2), the front abutting portions 31 contact the front stops 25 and the locking projections 34 are locked to the locking surfaces 23 of the lock projections 21. In the above way, the assembling of the cover 27 and the holding member 11 is completed.

With the assembling of the cover 27 and the holding member 11 completed, the clearances 42 between the front ends of the guide ribs 33 and the rattling preventing portions 18 are very small. Thus, the cover 27 and the holding member 11 do not rattle in the vertical direction, and vertical rattling of the inner conductors 35 in the accommodating chambers 15 is suppressed. Therefore, in connecting the mating terminal 41 and the inner conductor 35, a connecting operation is performed easily without causing any displacement between the mating terminal 41 and the inner conductor 35.

Further, in a state where the cover 27 is at the proper assembled position PAP and the side plates 29 are not deformed resiliently, there are hardly any clearances between the front ends of the guide ribs 33 and the rattling preventing portions 18. Thus, if an attempt is made to unite the cover 27 at the proper assembled position PAP, the side plates 29 are deformed resiliently and the guide ribs 33 are in contact with positions above the rattling preventing portions 18 and cannot slip under the rattling preventing portions 18 when the upper plate 28 contacts the upper ends of the side walls 13. Therefore, the side plates 29 cannot resiliently return and are left resiliently deformed. In this way, it can be discriminated that the united position of the cover 27 is not proper.

Further, if a rear end side of the cover 27 is lifted in the process of sliding the cover 27 from the temporary assembled position TAP to the proper assembled position PAP, the posture of the cover 27 can be corrected by the correcting slopes 22. If the cover 27 is displaced toward the proper assembled position PAP in such an inclined posture that the rear part thereof is lifted, the front ends of the locking projections 34 move onto the correcting slopes 22 without the locking projections 34 slipping under the lock projections 21 and the resilient locking portions 30 are deformed resiliently to be wider apart in the lateral direction.

Since the contact positions of the correcting slopes 22 with the front ends of the locking projections 34 are displaced more forward as the cover 27 is displaced more forward and the rear end side of the cover 27 is lifted more, the amount of resilient deformation of the resilient locking portions 30 increases. Along with this, resilient restoring forces of the resilient locking portions 30 also increase. Thus, the posture of the cover 27 is corrected in a direction to lower the rear end side by these resilient restoring forces of the resilient locking portions 30. Thus, the posture of the cover 27 is corrected and the locking projections 34 slip under the lock projections 21 and are locked to the locking surfaces 23 before the cover 27 reaches the proper assembled position PAP.

The terminal unit A of this embodiment has the inner conductors 35 fixed to the front parts of the wires 38 and the dielectric 10 for accommodating the inner conductors 35. The dielectric 10 is configured by uniting the holding member 11 and the cover 27 in the direction intersecting an axial direction of the wires 38. The holding member 11 is formed with the guide recesses 17 extending in the front-rear direction. The cover 27 is formed with the guide ribs 33 capable of sliding in contact with the guide recesses 17 and configured to allow relative displacement of the holding member 11 and the cover 27 in the front-rear direction while keeping the holding member 11 and the cover 27 united. The guide recesses 17 are formed with the guiding portions 19 for bringing the holding member 11 and the cover 27 closer to each other in the uniting direction in the process of displacing the cover 27 from the temporary assembled position TAP to the proper assembled position PAP in the front-rear direction.

The guide recesses 17 and the guide ribs 33 guide the cover 27 to the proper assembled position PAP and into a state where the cover 27 is united with the holding member 11 at the temporary assembled position TAP. Simultaneously, the guiding portions 19 bring the holding member 11 and the cover 27 closer to each other in the uniting direction to suppress rattling of the holding member 11 and the cover 27 in the uniting direction.

Further, the guide recesses 17 and the guide ribs 33 lock to each other to restrict the separation of the holding member 11 and the cover 27 in a direction opposite to the uniting direction. Thus, the shapes of the holding member 11 and the cover 27 can be simplified as compared to the case where a means for holding the holding member 11 and the cover 27 together is provided separately from the guide recesses 17 and the guide ribs 33.

Further, the guide recess 17 is formed such that the rattling allowing portion 20, the guiding portion 19 and the rattling preventing portion 18 are disposed side by side one after another on the outer side surface of the holding member 11. The cover 27 is formed with the resiliently deformable side plates 29 cantilevered in the same direction as the uniting direction with the holding member 11, and the guide ribs 33 project on extending end parts of the side plates 29. The guide ribs 33 and the rattling allowing portions 20 face each other with the clearances 42 defined therebetween when the cover 27 is at the temporary assembled position TAP. The guide ribs 33 proximately face or are in contact with the rattling preventing portions 18 when the cover 27 is at the proper assembled position PAP.

According to this configuration, if the cover 27 is united toward the proper assembled position PAP, the resiliently deformed side plates 29 become oblique to the uniting direction. Thus, the guide ribs 33 cannot be locked to the rattling preventing portions 18 and are left resiliently deformed. In contrast, if the cover 27 is united toward the temporary assembled position TAP, the side plates 29 are resiliently deformed and the guide ribs 33 face the rattling allowing portions 20 even if the resiliently deformed side plates 29 are oblique since the clearances 42 are secured between the rattling allowing portions 20 and the guide ribs 33.

Further, the rectangular tubular conductor bodies 36 are formed at the front parts of the inner conductors 35 and are connectable to the mating terminals 41. Additionally, the guiding portions 19 are at positions corresponding to the conductor bodies 46 in the front-rear direction. According to this configuration, the rattling of the conductor bodies 36 at the connection to the mating terminals 41 can be suppressed. Therefore, the inner conductors 35 and the mating terminals 41 will not interfere with each other and can be connected smoothly.

Further, the guiding portions 19 are disposed at the front end part of the holding member 11, the lock projections 21 are formed on the outer side surfaces of the rear end part of the holding member 11 and the cover 27 is formed with the resiliently deformable locking portions 30 cantilevered in the uniting direction with the holding member 11. The locking projections 34 are formed on the extending end parts of the resilient locking portions 30 and hold the holding member 11 together with the cover 27 by being locked to the locking surfaces 23 of the lock projections 21 when the cover 27 is at the proper assembled position PAP.

The correcting slopes 22 are formed in regions of the outer side surfaces of the lock projections 21 on the side of the temporary assembled position TAP in the front-rear direction. The correcting slopes 22 reduce the amount of resilient deformation of the resilient locking portions 30 as the cover 27 approaches the holding member 11 when the locking projections 34 interfere with the correcting slopes 22 in the process of displacing the cover 27 toward the proper assembled position. According to this configuration, the locking projections 34 interfere with the correcting slopes 22 in the process of displacing the cover 27 in an oblique posture toward the proper assembled position PAP. Thus, the posture of the cover 27 is corrected by resilient restoring forces of the resilient locking portions 30. The correcting slopes are formed on the outer side surfaces of the lock projections 21. Thus, locking margins between the locking projections 34 and the lock projections 21 can be ensured.

The holding member 11 has the front stops 25 extending along the uniting direction of the cover 27, and the cover 27 has the front abutting portions 31 extending along the uniting direction with the holding member 11 and are configured to contact the front stops 25 in the state where the cover 27 is at the proper assembled position PAP. According to this configuration, the inclination of the cover 27 with respect to the holding member 11 is prevented.

The invention is not limited to the above described embodiment, and the following embodiments also are included in the scope of the invention.

Although the cover is displaced forward from the temporary assembled position toward the proper assembled position in the above embodiment, the cover may be relatively displaced forward from the temporary assembled position toward the proper assembled position.

Although the first guide and the second guide also function to hold the cover and the holding member together in the above embodiment, the guides and means for holding the cover and the holding member together may be provided separately.

Although the guiding portions are only at the positions corresponding to the terminal bodies in the above embodiment, the guiding portions may be provided in regions of the terminal fittings behind the terminal bodies.

Although the first guide is a step in the above embodiment, the first guide may be a groove.

Although the terminal unit constituting a shield terminal by the terminal fittings functioning as the inner conductors and the terminal accommodating member functioning as the dielectric is described in the above embodiment, the invention can be applied also to terminal units not constituting shield terminals.

REFERENCE SIGNS

A . . . A terminal unit
10 . . . dielectric (terminal accommodating member)
11 . . . holding member (first member)
17 . . . guide recess (first guide)
18 . . . rattling preventing portion
19 . . . guiding portion
20 . . . rattling allowing portion
21 . . . lock projection
22 . . . correcting slope
25 . . . front stop portion (stopper)
27 . . . cover (second member)
29 . . . side plate
30 . . . resilient locking portion
31 . . . front abutting portion (abutting portion)
33 . . . guide rib (second guide)
34 . . . locking projection
35 . . . inner conductor (terminal fitting)
36 . . . conductor body (terminal body)
38 . . . wire
41 . . . mating terminal
42 . . . clearance

What is claimed is:

1. A terminal unit, comprising:

at least one terminal fitting fixed to at least one wire;

a terminal accommodating member including a holding member having opposite first and second side walls extending in a forward to backward direction and at least one accommodating chamber formed between the first and second side walls and configured for accommodating the at least one terminal fitting, and a cover mounted to the holding member in a uniting direction intersecting the forward to backward direction, the cover being movable in the forward to backward direction between a temporary assembled position and a proper assembled position;

at least one first guide formed on an outer surface of at least one of the first and second side walls of the holding member and substantially extending in the forward to backward direction, the at least one first guide including at least one rattling preventing portion at a forward end thereof and at least one guiding portion inclined from a rear end of the at least one rattling preventing portion towards the cover; and at least one second guide formed on the cover and engaging the at least one first guide, the at least one second guide sliding in contact with the at least one guiding portion and engaging the at least one rattling preventing portion to move the cover and the holding member towards each other in the uniting direction when the cover is moved from the temporary assembled position to the proper assembled position.

2. The terminal unit of claim 1, wherein the separation of the cover and the holding member in a direction opposite to the uniting direction is restricted by locking the first and second guides together.

3. The terminal unit of claim 2, wherein the first guide is formed such that at least one rattling allowing portion is formed rearward of the at least one guiding portion.

4. The terminal unit of claim 1, wherein the second guide has at least one resiliently deformable side plate cantilevered in substantially the same direction as the uniting direction with the holding member.

5. The terminal unit of claim 4, wherein the second guide is a projection formed on an extending end part of the side plate.

6. The terminal unit of claim 4, wherein the second guide substantially faces the rattling allowing portion with a clearance defined therebetween in a state where the cover is at the temporary assembled position and proximately faces or is in contact with the rattling preventing portion in a state where the cover is at the proper assembled position.

7. The terminal unit of claim 1, wherein:

a tubular terminal body connectable to a mating terminal is formed at the terminal fitting; and the at least one guiding portion is disposed at a position substantially corresponding to the terminal body in the front-rear direction.

8. The terminal unit of claim 1, wherein:

the at least one guiding portion is disposed on a front part of the holding member;

at least one lock projection is formed on an outer side surface of a rear end part of the holding member;

the cover is formed with at least one resiliently deformable locking portion cantilevered in the uniting direction with the holding member; and at least one locking projection is formed on an extending end part of the resilient locking portion and is configured to hold the holding member and the cover together by being locked to the lock projection in a state where the second member is at the proper assembled position.

9. The terminal unit of claim 8, wherein a correcting slope is formed in a region of an outer side surface of the lock projection on the side of the temporary assembled position and is configured to reduce an amount of resilient deformation of the resilient locking portion as the cover approaches the holding member when the locking projection interferes with the correcting slope in the process of displacing the cover toward the proper assembled position.

10. The terminal unit of claim 1, wherein:

the holding member is formed with at least one stopper substantially extending along the uniting direction of the second member; and the cover is formed with at least one abutting portion substantially extending along the uniting direction with the holding member and configured to come into contact with the stopper in a state where the cover is at the proper assembled position.

* * * * *